US011401713B2

(12) United States Patent
Wagaman et al.

(10) Patent No.: US 11,401,713 B2
(45) Date of Patent: Aug. 2, 2022

(54) LINEAR DRIVE LOUVERED ROOF APPARATUS AND CONTROL SYSTEM

(71) Applicants: Clark R. Wagaman, Folsom, CA (US); Mark C Jacobs, Sacramento, CA (US)

(72) Inventors: Clark R. Wagaman, Folsom, CA (US); Mark C Jacobs, Sacramento, CA (US)

(73) Assignee: CLARK WACMAN DESIGNS, Sacramento, CA (US)

( * ) Notice: Subject to any disclaimer, the term of this patent is extended or adjusted under 35 U.S.C. 154(b) by 0 days.

(21) Appl. No.: 16/873,602

(22) Filed: May 19, 2020

(65) Prior Publication Data

US 2021/0363752 A1 Nov. 25, 2021

(51) Int. Cl.

| | |
|---|---|
| ***E04B 7/16*** | (2006.01) |
| ***E04D 13/068*** | (2006.01) |
| ***E04F 10/10*** | (2006.01) |
| ***E04D 13/035*** | (2006.01) |

(52) U.S. Cl.

CPC ..... *E04B 7/163* (2013.01); *E04D 13/068* (2013.01); *E04F 10/10* (2013.01); *E04D 13/0354* (2013.01)

(58) Field of Classification Search

CPC ... E04B 7/163; E04D 13/068; E04D 13/0354; E04D 13/064; E04F 10/10; E04F 10/08; F24F 7/02; F24F 13/15; E06B 7/086; E06B 7/14; E06B 9/386

See application file for complete search history.

(56) References Cited

U.S. PATENT DOCUMENTS

| | | | | | |
|---|---|---|---|---|---|
| 2,293,065 | A * | 8/1942 | Kiczales | F24F 13/15 | 454/335 |
| 2,456,311 | A * | 12/1948 | Paget | F24F 13/15 | 454/335 |
| 3,044,387 | A * | 7/1962 | Hinden | F24F 13/15 | 49/77.1 |
| 3,084,405 | A * | 4/1963 | Kahn | F24F 13/15 | 49/390 |
| 3,120,035 | A * | 2/1964 | Morris | E06B 9/367 | 49/77.1 |
| 3,769,810 | A * | 11/1973 | Swartwout | F24F 13/15 | 62/183 |
| 4,199,898 | A * | 4/1980 | Connor | E06B 7/086 | 137/601.06 |
| 4,313,650 | A * | 2/1982 | Ward | A01G 9/222 | 359/596 |
| 4,469,132 | A * | 9/1984 | Redington | F24F 13/15 | 137/601.06 |
| 5,238,453 | A * | 8/1993 | Heil | F24F 13/15 | 137/601.09 |

(Continued)

*Primary Examiner* — Brian D Mattei
*Assistant Examiner* — Omar F Hijaz
(74) *Attorney, Agent, or Firm* — Mark C Jacobs

(57) ABSTRACT

A new louver, and a louvered roof assembly having a plurality of these louvers is provided wherein the plurality of louvers, are movable within a frame between an open condition and a closed condition. The louvers, each having first and second ends, are pivotally coupled to the frame for rotation about an axis. A linear drive motor is coupled to a moveable arm bar to which each louver is connected by a pin which pin is attached at the pin's opposite end to a member disposed within the center of each respective louver. Single set and dual sets of louvers may be operated by a single linear drive actuator.

14 Claims, 17 Drawing Sheets

(56) References Cited

U.S. PATENT DOCUMENTS

| | | | | |
|---|---|---|---|---|
| 5,941,021 | A * | 8/1999 | Valls, Jr. | E06B 7/086 49/92.1 |
| 2005/0076569 | A1 * | 4/2005 | Griffiths | E06B 7/096 49/82.1 |
| 2008/0245489 | A1 * | 10/2008 | Chuang | E06B 7/08 160/236 |
| 2014/0175240 | A1 * | 6/2014 | Selzer | E04F 10/10 248/237 |

* cited by examiner

LINEAR DRIVE LOUVERED ROOF APPARATUS AND CONTROL SYSTEM

FIELD OF THE INVENTION

This application relates to a covered patio roof having a series of adjacent uniquely shaped louvers which roof employs a linear drive system attached to the series of louvers to open and close said patio roof.

BACKGROUND OF THE INVENTION

Conventional louvered roof apparati generally include a plurality of parallel louvers which are pivotally supported on a frame above a patio or over a portion of a house. The louvered roof assemblies, often referred to as patio covers, are adjustable and may be opened or closed by either a motor operated by a by a person, usually with a remote control, or a wall mounted switch.

Many issues arise with the louvered roof assemblies that are being marketed today. For example, the individual louvered roof panels are not configured to close directly one on to another. No one wants gaps that could permit rain or snow to impact occupants sitting underneath the pergola.

Deficiencies also exist in the design of the motors and actuators which move to open and close the panels. In some products on the market, the overlapping surface area of the motor assembly is located within the water flow area of a gutter of the structure. Such a configuration could result in water damage to the motor and a possible short circuit.

SUMMARY OF THE INVENTION

There are several key aspects to this invention. One main portion of this invention is the shape of the individual louvers. They are aerodynamic so as to resist possible wind damage, and to ensure that upon closure of the roof, the units close tightly and overlap to prevent rain entry.

Another major aspect is the use of a linear drive motor for smooth open and closing operation. Unlike other closeable roof systems of the past, this invention utilizes a direct coupling of the linear drive motor to the louver assembly, by passing any external gear systems that might need periodic maintenance or replacement.

The third main aspect herein is the mode of attachment of the linear drive motor to the series of louvers.

All of these aspects will be discussed in detail infra.

It is a first object of the invention to provide a unique aerodynamically shaped louver for the roof system of this invention.

It is a second object to provide a direct coupled linear drive motor system for the closeable roof system of this invention.

The third object is to provide a means for the coupling of a single linear drive motor to either a single row or double row (set) of louvers openable roof.

A fourth object is to have a linear drive motor system to operate both a single and a double set of louver panels.

Other objects of the invention will in part be obvious and will in part appear hereinafter.

Further objects of this invention will become apparent from a careful reading of the detailed description provided herein as well as from review of the drawings The invention accordingly comprises the apparatus possessing the features properties and the relation of components which are exemplified in the following detailed disclosure and accompanying drawings, and the scope of the application of which will be indicated in the appended claims.

For a fuller understanding of the nature and objects of the invention reference should be made to the following detailed description, taken in conjunction with the accompanying drawings.

DESCRIPTION OF THE PREFERRED EMBODIMENT

Introduction

As used herein the term single set of louvers, means a plurality of louvers linearly spaced from each other and connected to the drive system of this invention with the drive system mounted either to the left or right of the plurality of louvers.

A dual set of louvers would be found in a covered patio, a.k.a pergola, wherein there are two pluralities of linearly spaced louvers, one set laterally spaced from the other set, with the drive means disposed between the two sets of louvers. Both sets of the louvers move in the same direction simultaneously.

Preface

In order to understand the details of this invention, it is necessary to understand the various components that constitute elements of this invention. The first element to be discussed is the new aerodynamic louver used herein. The second most important is the linear drive actuation system. Applicant is not the first to use a linear drive system for moving the plurality of louvers, but applicant is the first to use the means described herein for the connection of the linear drive system to the plurality of louvers to control their movement to and fro.

Figures 1, 2:
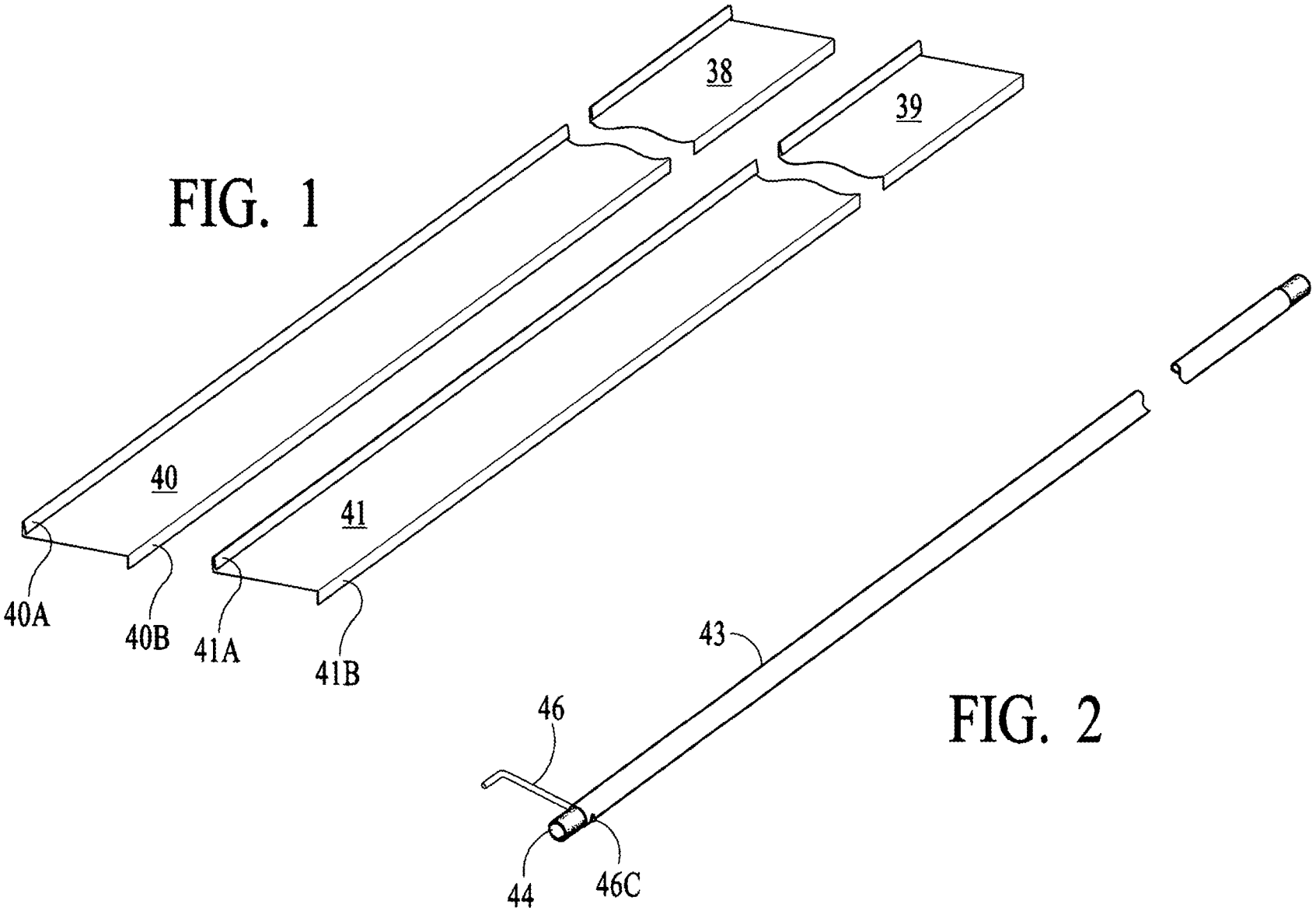
FIG. 1 is a perspective view of two sheet members used to form one of the first utilized in this invention
FIG. 2 is top perspective view of an elongated tube having a polymeric cylinder disposed of each thereof and a connecting pin inserted into the tube and one polymeric.

Let us turn now to FIG. 1. Here two elongated sheets of aluminum that have been pre-painted with a texture finish are seen. These sheets designated 38 AND 39 have main sections 40 and 41. Each main section has a first end 40A and 41A respectively which have been folded upwardly as on a brake, 90 degrees. Then at about the midpoint along the full length of this upturned segment, a second bend is made in the upturned segment downwardly toward the respective main section. At the opposing end of the width of the sheets 38 and 39, a single fold or bend downwardly 90 degrees is made. The result is as seen two sheets having full length tabs raised up at one end of the width, full length in opposite directions, one upwardly and one downwardly. These two doubly bent members form the body of the aerodynamic louver of this invention.

We now turn to FIG. 2. Here a long metal tube equal to the length of a louver is seen and which is designated 43. At both ends or terminii, thereof there is disposed a polymeric plug about 2 to 3 inches long, often of nylon or Delrin®. The plug 44 is retained in place by a sheet metal screw 47 disposed through an unnumbered aperture into the plastic cylindrical plug.

Figure 3:
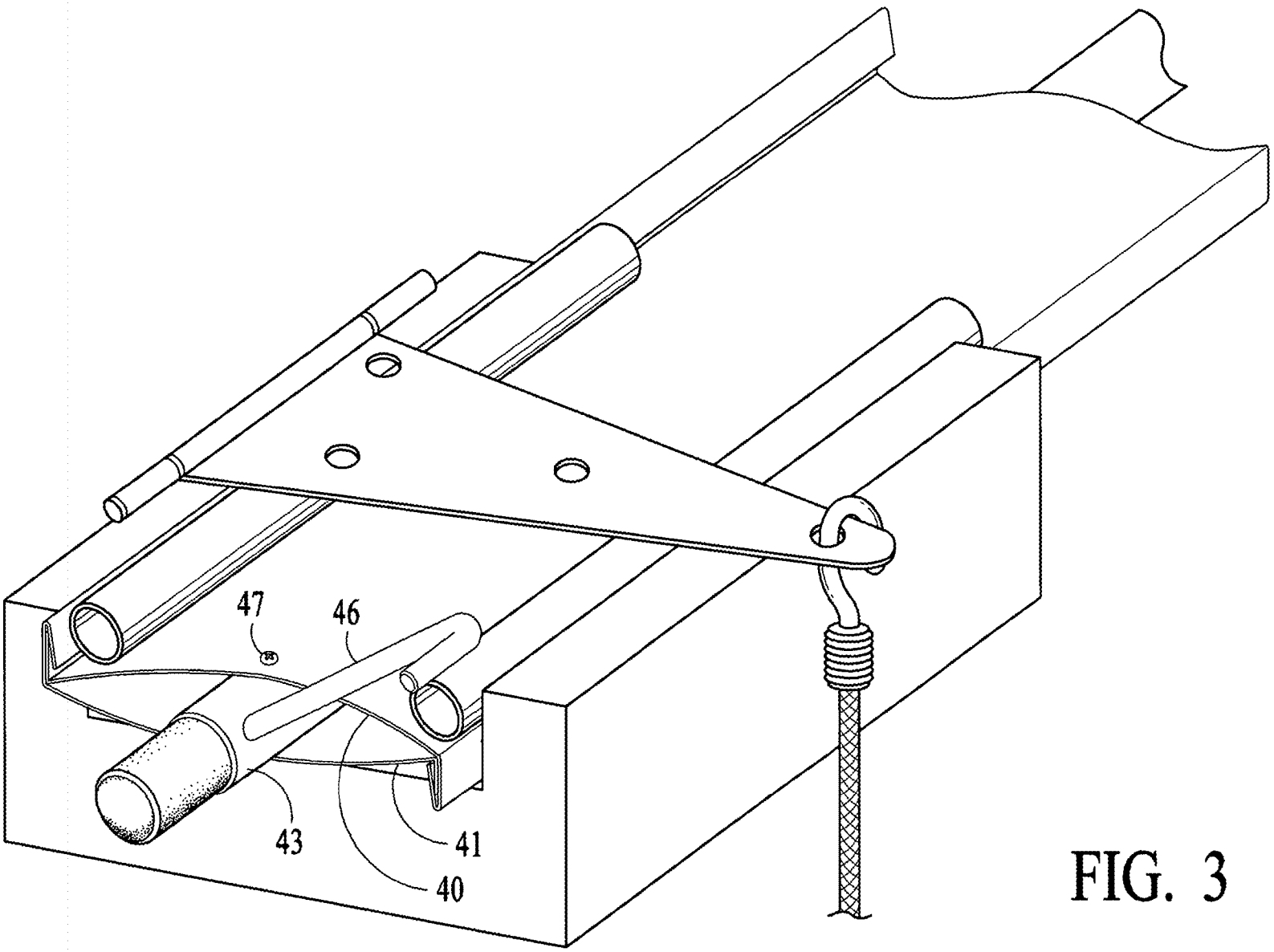
FIG. 3 is a top perspective view of one step showing the assembly of the two metal members of FIG. 1 into the louver configuration.
Figure 4:
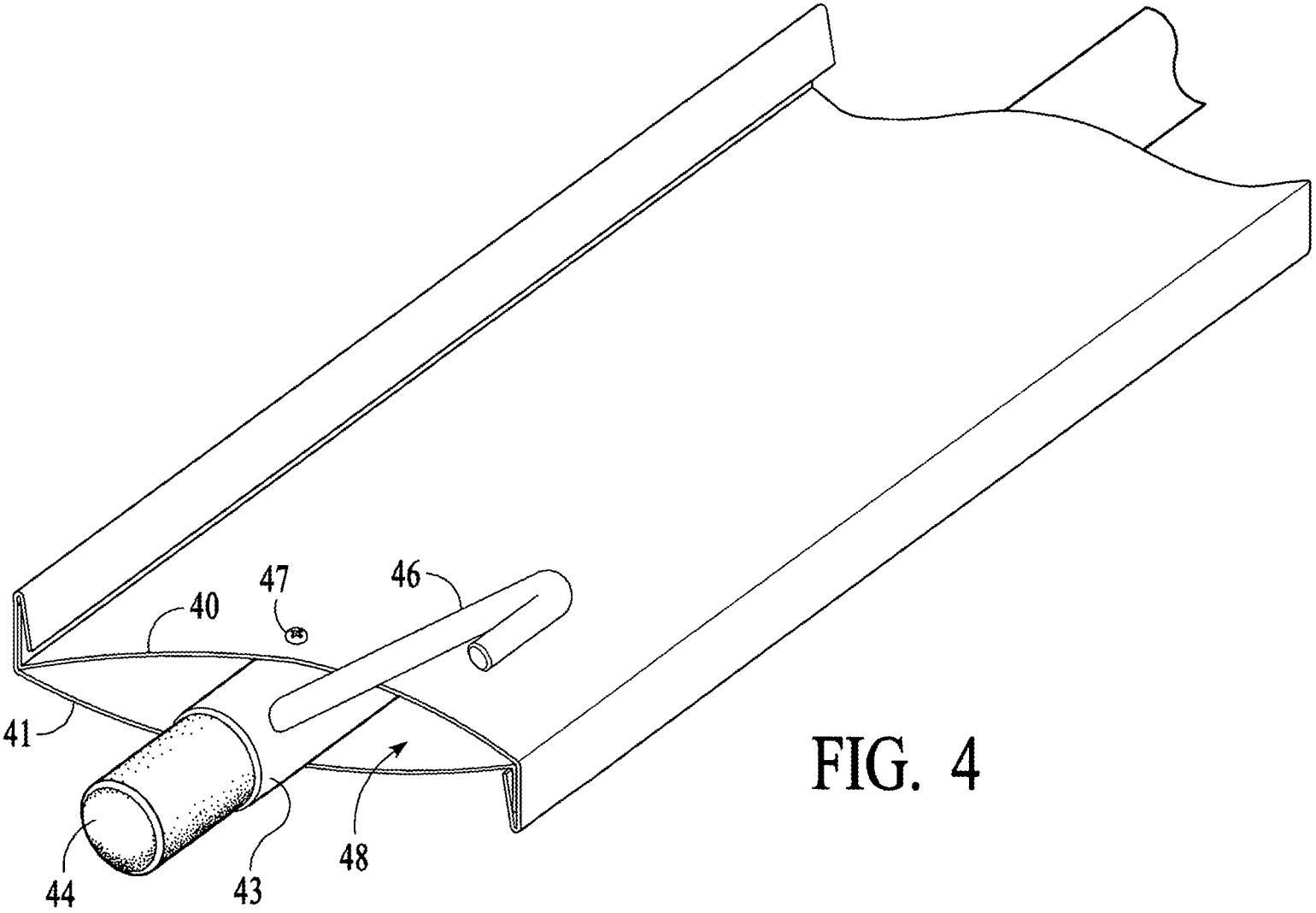
FIG. 4 is a top plan view of an assembled louver of this invention.

In FIG. 3, we see the louver coming into shape. Members 40 and 41 are re-oriented 180 degrees such that the as seen in FIG. 1, 41B flange would be on the left side of the viewer, facing upwardly and the folded edge 41A would be facing downwardly on the right of the viewer. The two members (sheet metal segments) are then merged such the flange 41B is inserted into the fold of 40A, and the flange of 40B is inserted within the fold of 41A. See also FIG. 7. Then the tube 43 is inserted down the lengthwise middle of the just formed sandwich to give rise to the aerodynamic shape of the louver. After proper tapping, a sheet metal screw 47, is disposed through the upper layer of sheet metal into the tube on both ends of the tube. Since the pin 46 was disposed within the tube's end adjacent the polymeric insert, in FIG. 2, it remains in the desired position in FIG. 3. Only one pin is used, as the second end of the tube is left untapped.

Figure 5:
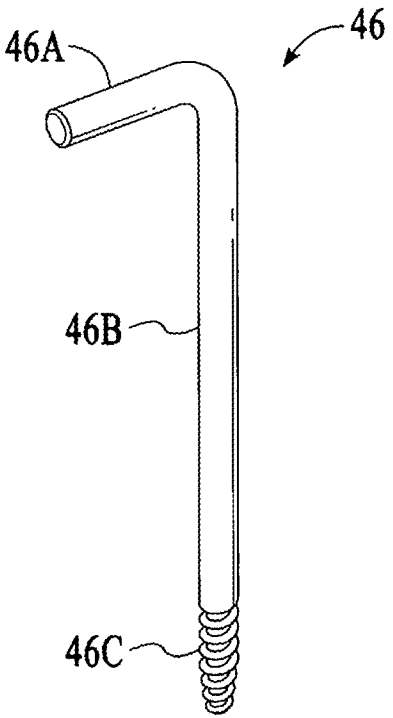
FIG. 5 is a plan view of the inverted L-shaped pin used in connection with this invention.
Figure 6:
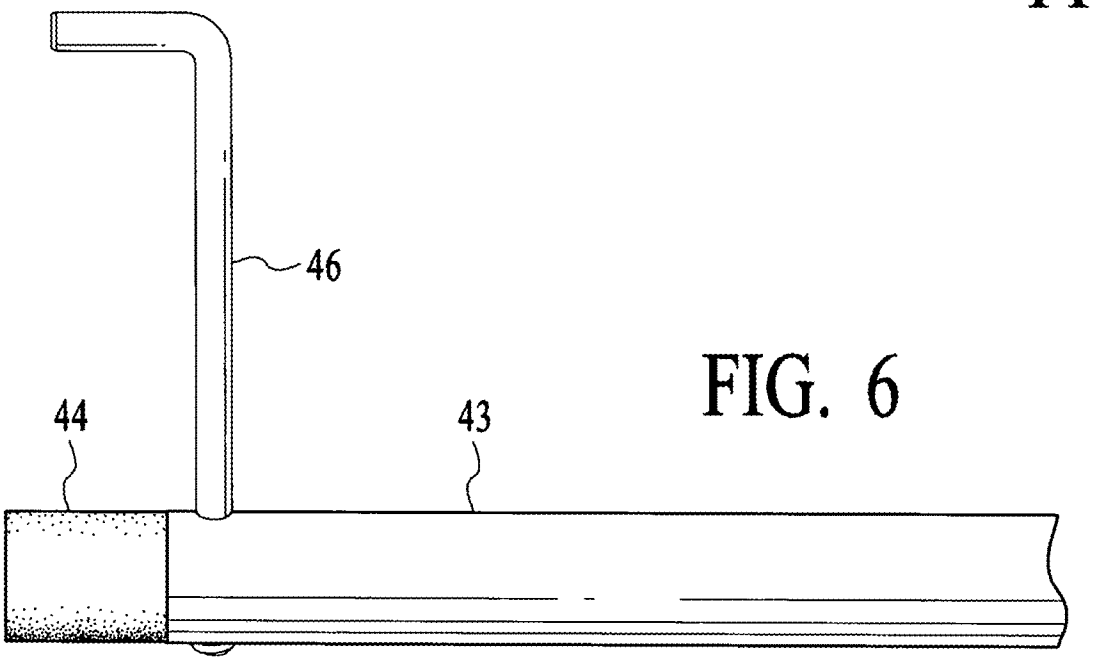
FIG. 6 is an elevational view showing the pin of FIG. 5 disposed in the elongated tube used as a component of the louver of this invention.

To further clarify the nature of pin 46, it is depicted by itself in FIG. 5. It is of an inverted L-shaped configuration and has an unthreaded head portion of cylindrical shape connected at a 90 degree radius to a longer shaft portion 46*b* Which terminates at its opposite end in a threaded section 46C. Note the pin inserted into the tube per FIG. 6.

Figure 7:
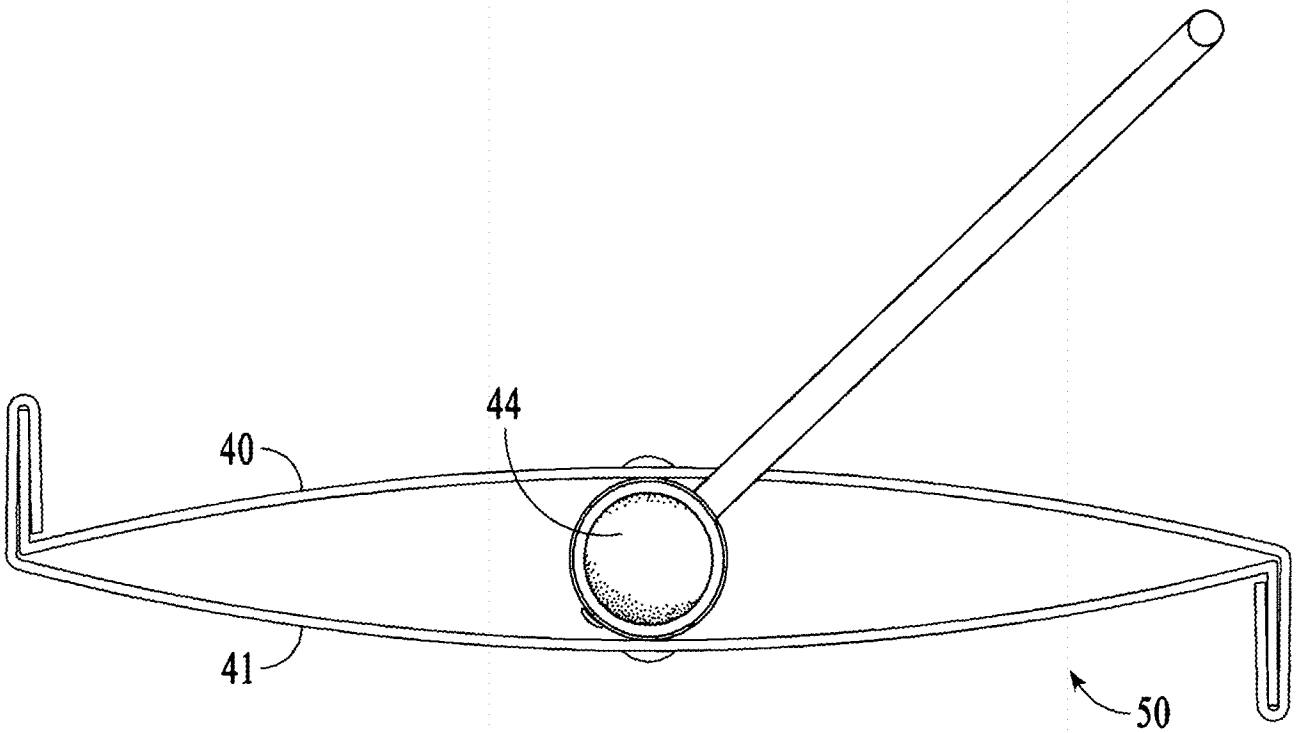
FIG. 7 is an end view of an assembled louver.
Figure 8:
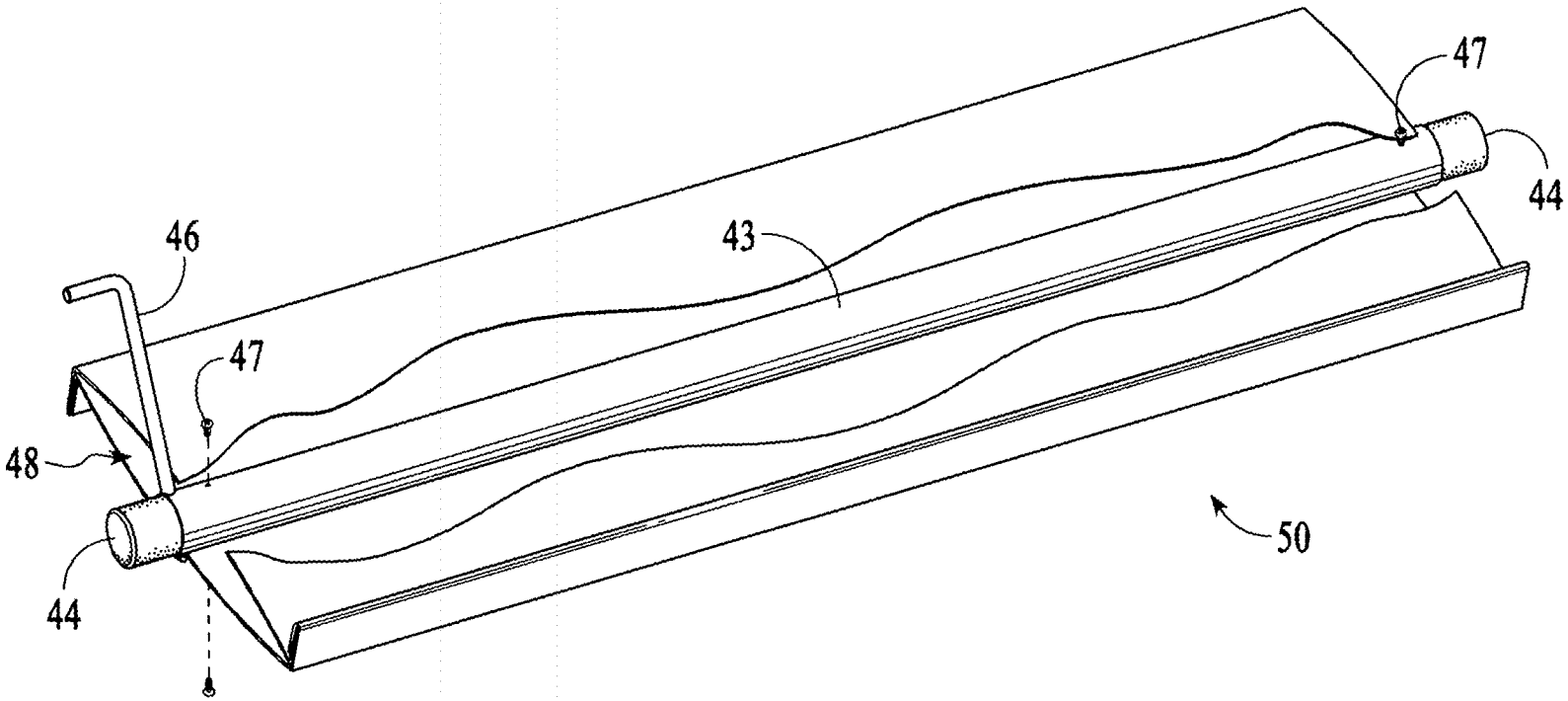
FIG. 8 is a top plan cutaway view of the louver of FIG. 7.

FIG. 7 has been referred to previously and is an end elevational view of an assembled louver a.k.a. panel, 50. FIG. 8 is duplicative in a sense in that it shows a cutaway view of the louver with the tube and its two polymeric inserts (plugs) and the pin aforementioned.

Figure 9:
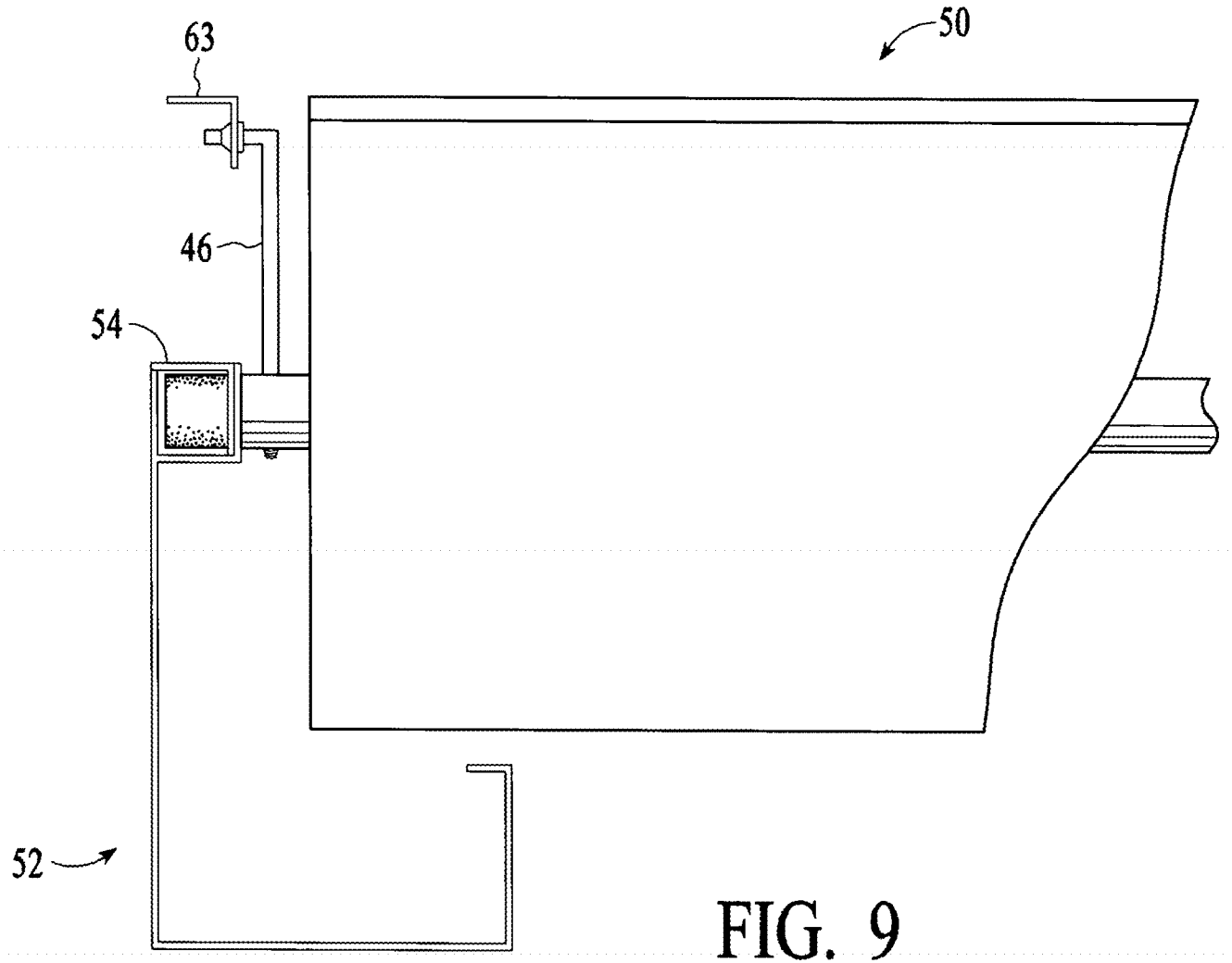
FIG. 9 is a rear elevational view depicting the mounting of a louver end into the gutter beam component of the invention and the disposition of the gutter beam cover over the gutter beam.

In FIG. 9 a cross section of the gutter beam 52 which is part of the frame, receives a plurality of louvers along its length is seen. The reader is requested to also view FIG. 10 which is a perspective view of the gutter bar 52. Each polymeric end is disposed in a successive U channel 52A4 as seen in the next figure. Returning to FIG. 9, it is seen also that an arm bar 54 overlays the open edge of the U channel 52A4 to prevent the louver's polymeric insert from popping out. The arm bar 54 acts as an inhibitor to prevent any and all of the successive plurality of the louver from dis-locating.

Figure 10:
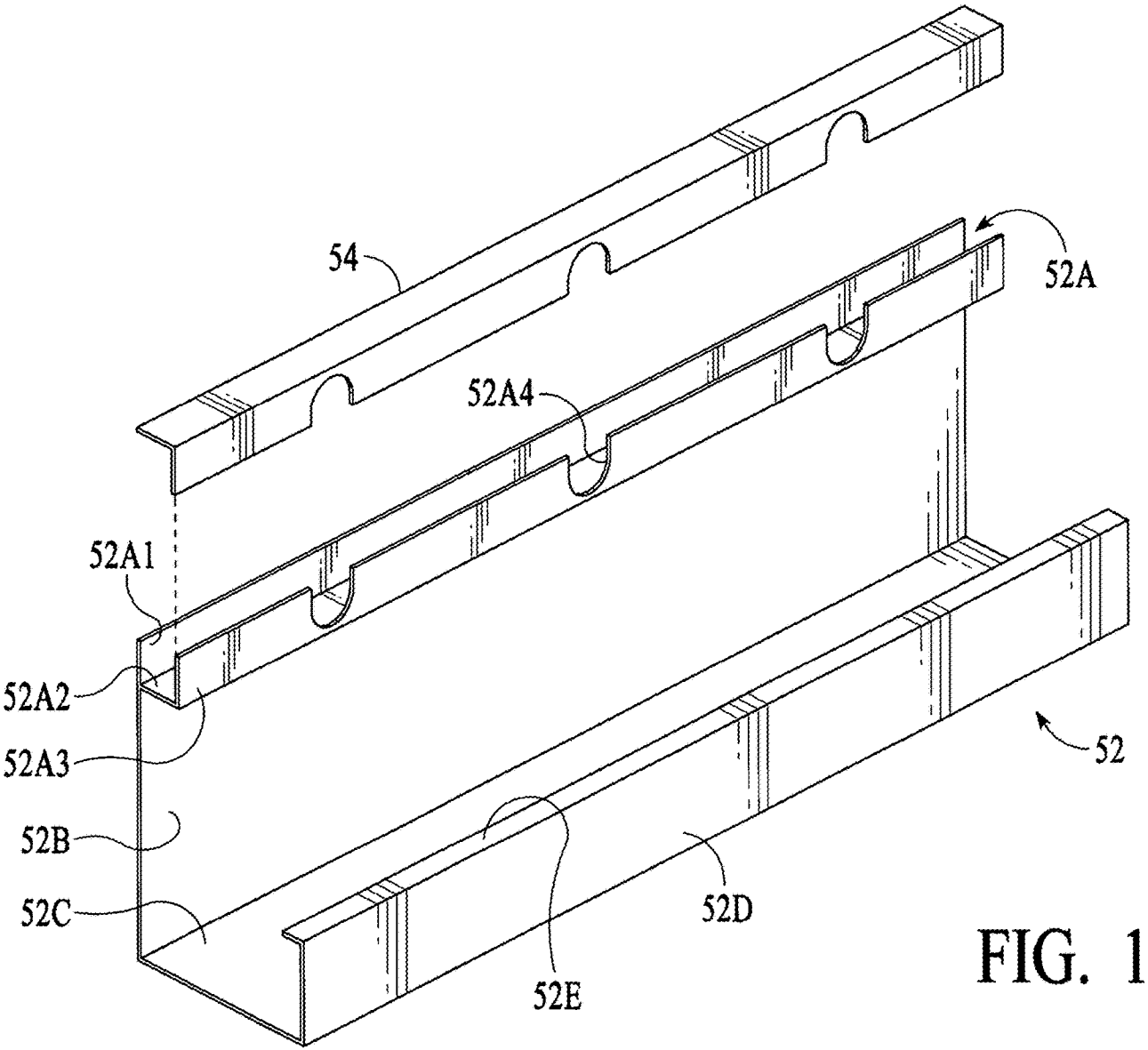
FIG. 10 is a perspective view of the gutter beam component of this invention.

Turning now to FIG. 10, the elements of the design patent pending gutter beam, are seen and discussed. Thus the gutter beam 52 is seen to be a generally L-shaped member with a U-channel 52A disposed along the vertical arm 52B of the L-shaped member. See infra. This U-shaped channel has a first vertical wall 52A1, a horizontal wall connected thereto 52A2, and a spaced 2'^d vertical wall 52A3 of the same elevation as wall 52A1. Second wall 52A3 has a series of linearly aligned spaced U shaped channels 52A4 along the length thereof for the receipt of polymeric plugs from a series of louvers. Wall 52A1 of the U-channel is contiguous with wall 52B and may be disposed at the upper edge thereof.

Extending normal from wall 52B of the L-shaped member is a horizontal wall 52C, which is connected at its first end to wall 52B and at its second end, to a spaced vertical second wall 52D, of a lesser elevation than spaced wall 52B. At the 2nd edge of vertical wall 52D, there is an inwardly disposed short flange 52E that, as with all of the aforementioned walls, extends the full length of the gutter beam 52.

Figure 11:
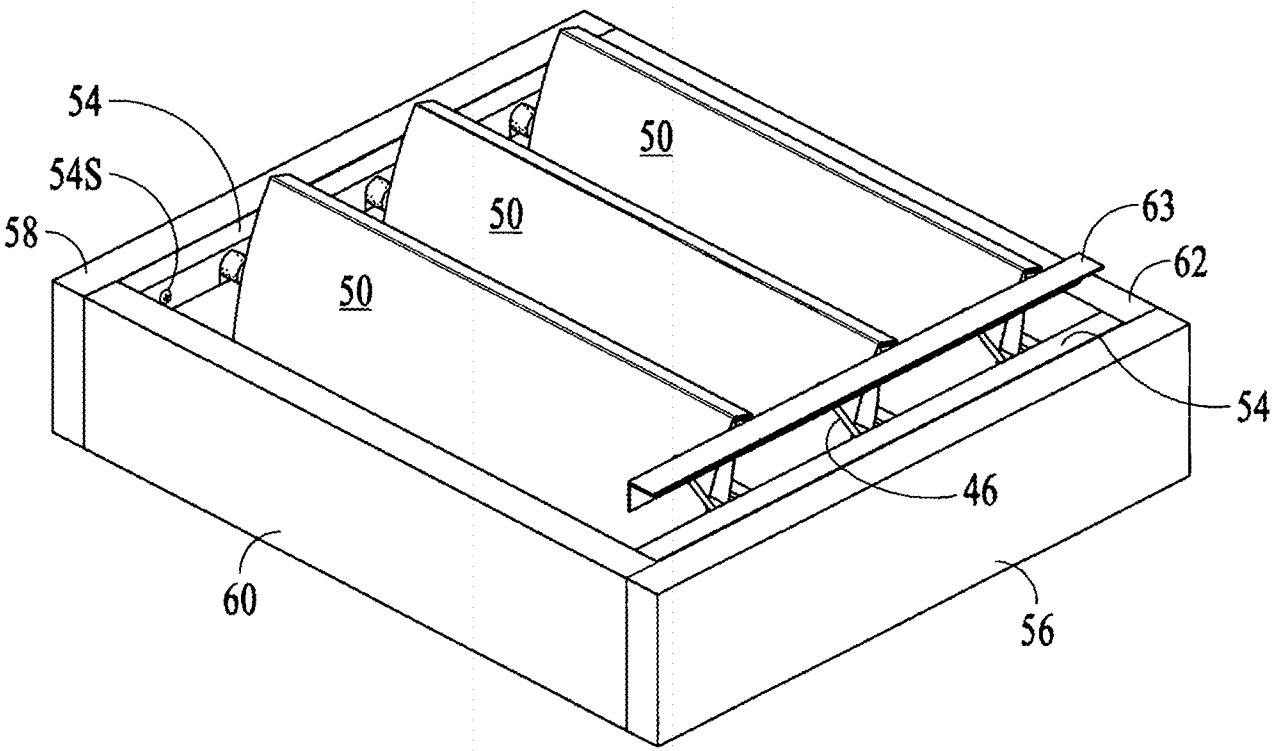
FIG. 11 is a top left perspective view of a single set of louvers showing the connection to the drive bar, but minus the linear drive motor with the louvers fully open.

The discussion now moves from individual components to the discussion of a full covered patio as seen in FIG. 11. The superstructure of the covered patio comprises a first set of elongated beams unusually of wood or aluminum 56 of a finite length, spaced from a parallel second set of beams 58 of equal length. Normal to these superstructure beams are transverse superstructure beams 60 of the same material as the first set of beams. Spaced from beams 60 ans parallel thereto is a second set of transverse beams 62.

A gutter cover 54 which is an inverted L-shaped member as seen in FIG. 10 overlays portion 52A of the gutter beam and is attached by a series of spaced sheet metal screws 54S. The gutter cover prevents the polymeric cylinder from coming out of the respective U-shape cutout or opening in which it has been disposed. One gutter cover 54 is posed on top of each gutter beam.

Arm bar 63 only one of which is utilized with each set of louvers, and which is also an inserted L shaped metal or plastic member is seen in FIG. 11 and other figures. See also FIG. 16. Arm bar 63 has a series of spaced apertures set out linearly to receive all of the portions 46A of the threaded pins 46. As will be discussed infra, the movement of the arm bar is directed by the linear actuator to be discussed infra.

Figure 12:
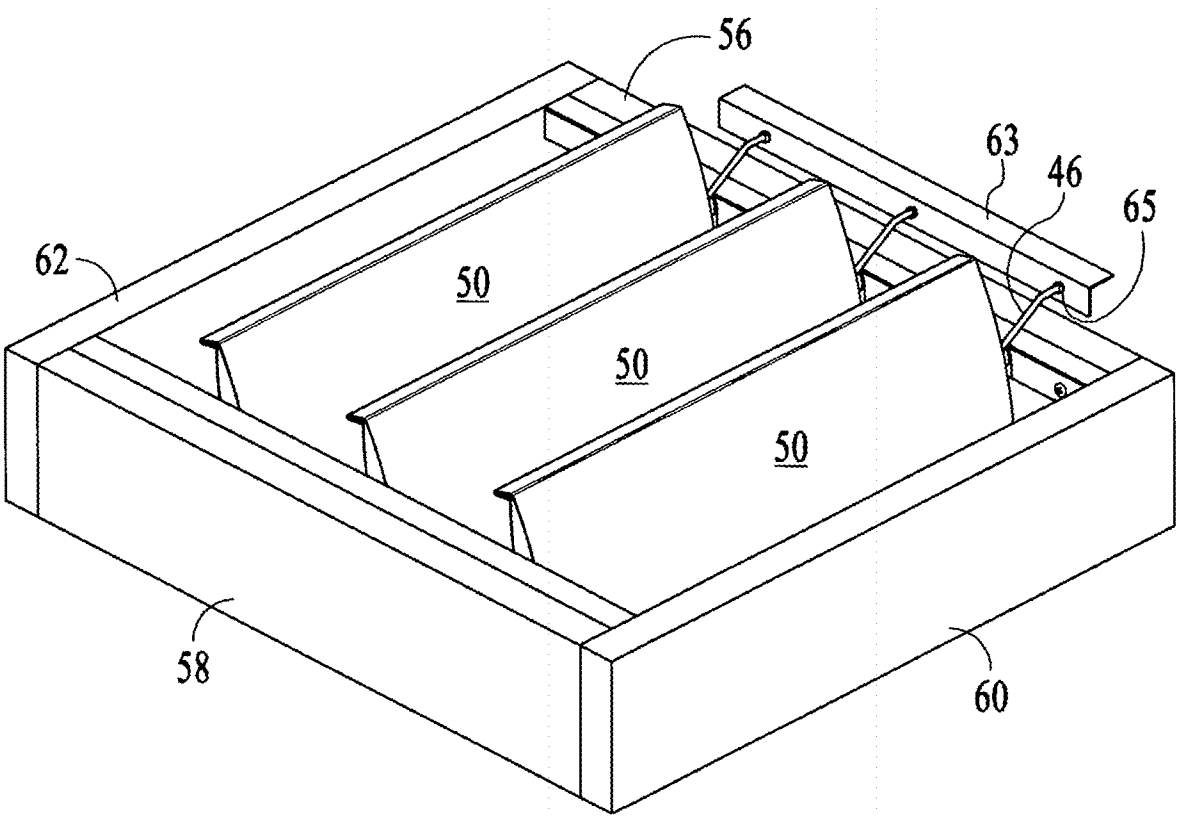
FIG. 12 is a view similar to FIG. 1 but taken from the left perspective.
Figure 13:
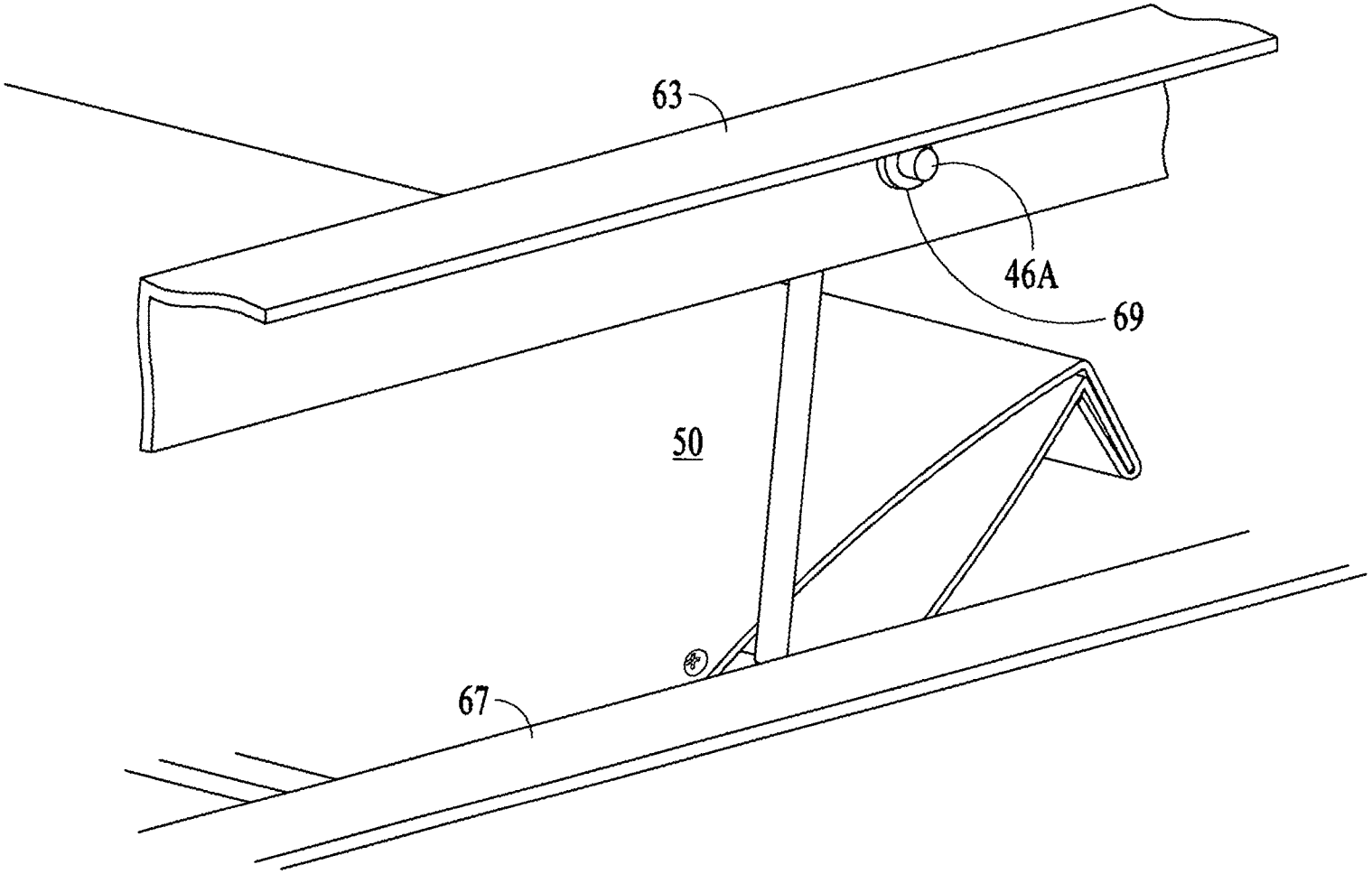
FIG. 13 is a closeup view showing the connection between a single louver and the rear side of the drive bar.

FIG. 12 is related to FIG. 11 but from the opposite perspective. Here arm bar 63 is seen in a raised condition with three pins 46 set into unnumbered apertures in said bar. A series of rubber grommets, 65, engage each and all unnumbered apertures and frictionally engage the head portions 46A of the pins therein respectively. Since as seen the head portions 46A are threaded they are secured in their respective aperture by a cap nut 69 as seen in FIG. 13 in closeup.

So now the question comes as to how does the arm bar which is connected to each pin which in turn is connected to its own louver, move the series of louvers all at one time. The answer lies in FIGS. 14-17 inclusive.

As stated at the very beginning of this patent application, applicant is not the first inventor to employ a linear drive actuator to move the louvers of a covered patio (pergola). But he is the first to employ the drive mechanism used herein.

Figure 14:
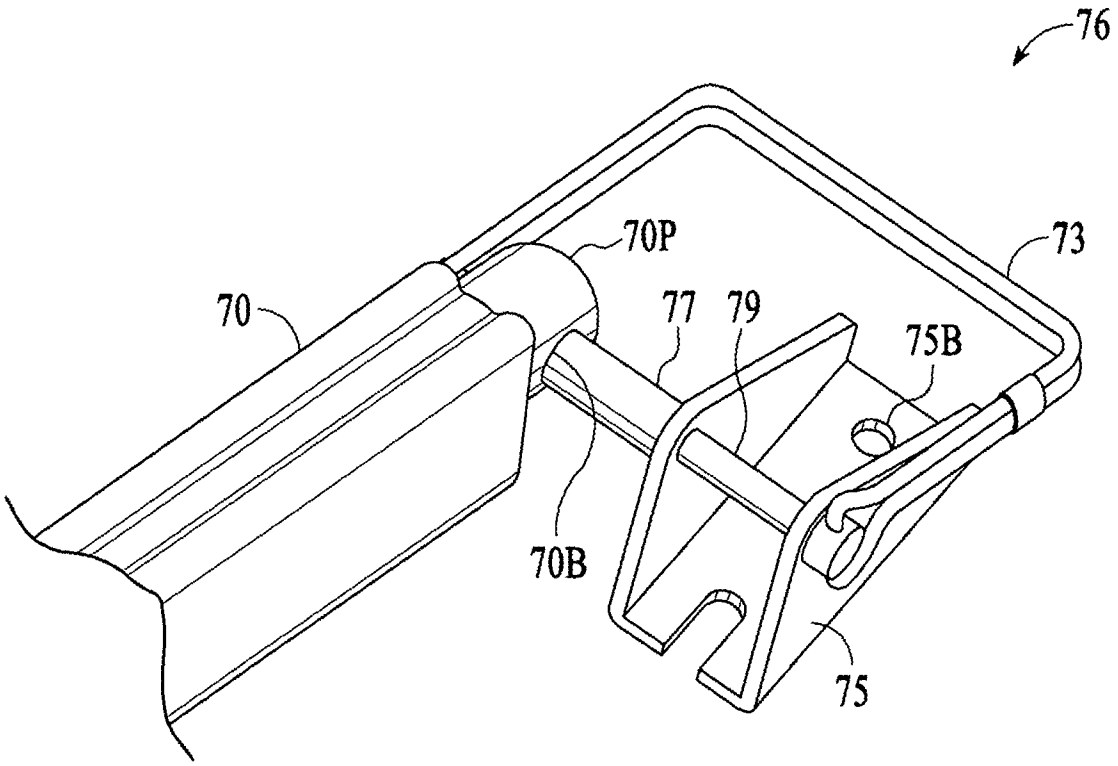
FIG. 14 is closeup view of the linear actuator used in this invention with piston extended and showing the connection utilized to drive a single bay (set) of louvers.

In FIG. 14, a linear actuator, such as a model FA-35-12-6"-P made by Firgelli Automation and designated 70 is seen removed from its mounting on the roof system. Piston 70P is seen extending forwardly from the body of the linear actuator 70. Attachment means 76 is seen disposed in the piston 70P through throughbore 70B. Attachment means 76 as seen here is intended for use with a single set of louvers. Attachment means 76 comprises a polymeric optionally hollow cylinder 77 disposed in said throughbore 70B. Wherein, a clevis pin 79 passes through a first end of a clevis, 73, then through a shoe 75, attached to said clevis, and then through said polymeric cylinder 77, and is attached to the second end of the clevis 73. The shoe is also attached to the arm bar in a fixed manner such that as the piston goes forwardly or rearwardly, the arm bar moves in the same direction rearwardly, and the single set of louvers moves from either a closed to an open position or vice versa. That is, the set of louvers rotates due to the movement of the arm bar 63 such that each pin 46 moves linearly, causing the polymeric plug to rotate in its respective U-channel.

Figure 15:
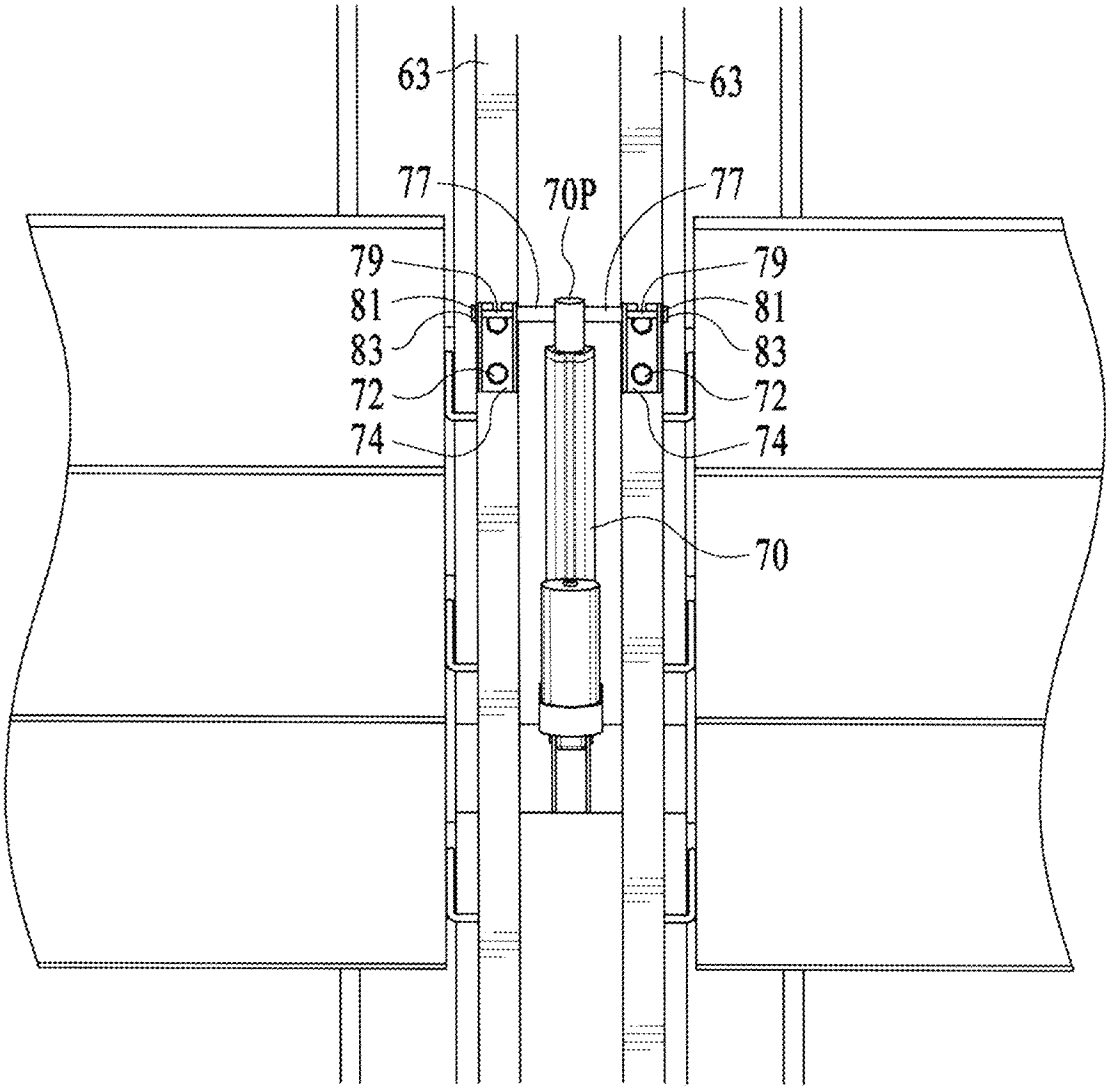
FIG. 15 is closeup a top plan view showing the linear actuator connected to a dual bay of louvers (2 sets)

In FIG. 15, the linear drive is shown mounted between two arm bars 63 of the roof system. Here, the piston 70P is seen almost fully extended and the linear actuator is mounted at its rear by shoe 71 to the spaced arm bars 63, of the roof system adjacent two sets of louvers by a pair of screws 72. For the dual set of louvers, movement is achieved by deploying a long bolt 79B first through the two upstanding legs of the shoe 74 via unnumbered aligned bores, then the bolt passes through the polymeric cylinder 77, then through the second shoe 74 to be retained by a washer 81 and nut 83. The bolt head 83 may be spaced from the right side shoe by washer 81. The two shoes 74 are seen to be also attached by screws 72 to the two arm bars 63. Therefore both sets of louvers will open or close a like amount when the piston is actuated using the same motion scheme as described for the single louver set movement.

Figure 16:
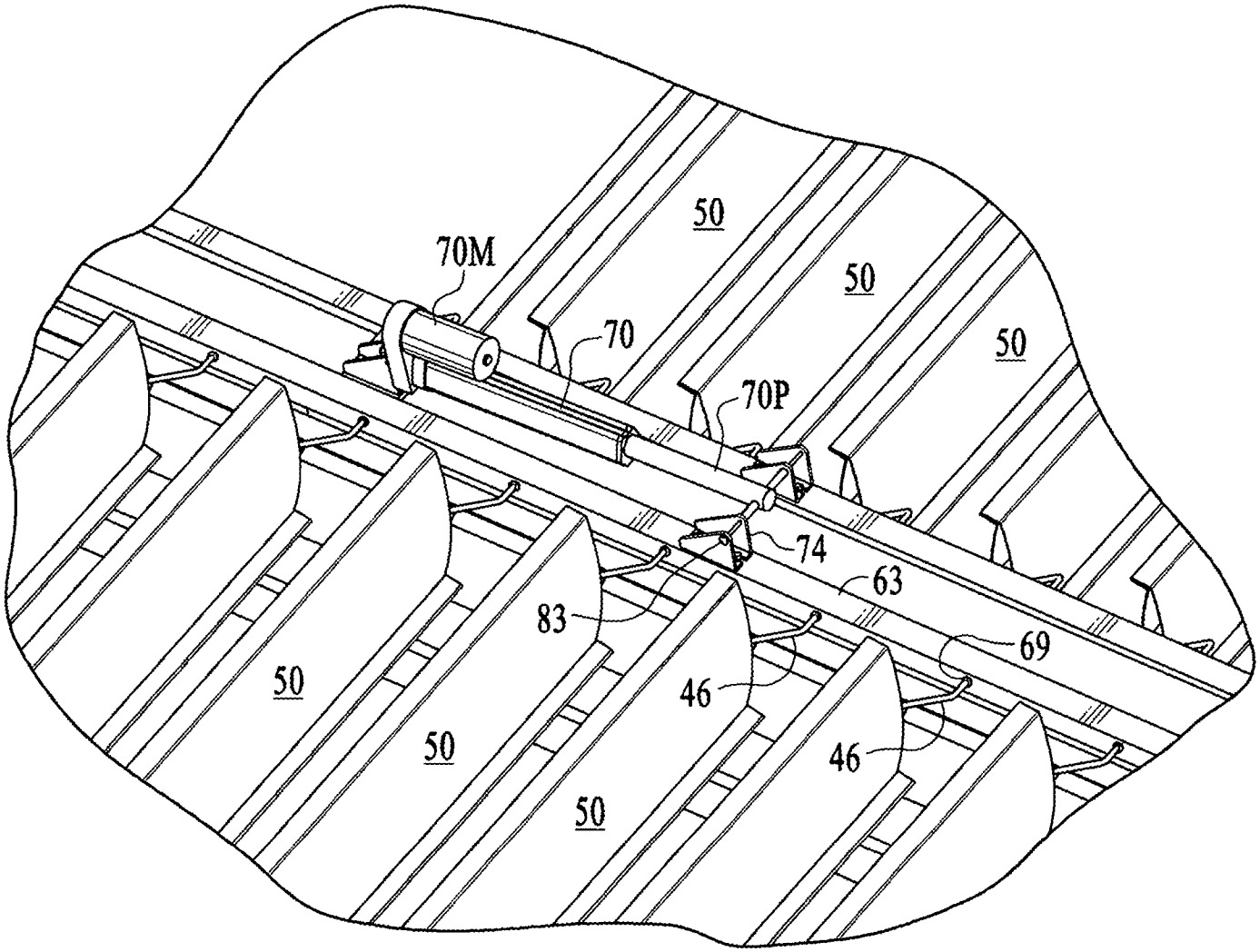
FIG. 16 is a top perspective orientated view showing the linear actuator connected to a dual set of louvers.

FIG. 16 is similar to FIG. 15 but from a different perspective. Here the vantage point is a right side perspective view. Shoe 74 is seen to be disposed and attached to the horizontal surface of arm bar 63 for movement. The louver sets 50 are seen to be in an open position.

Figure 17:
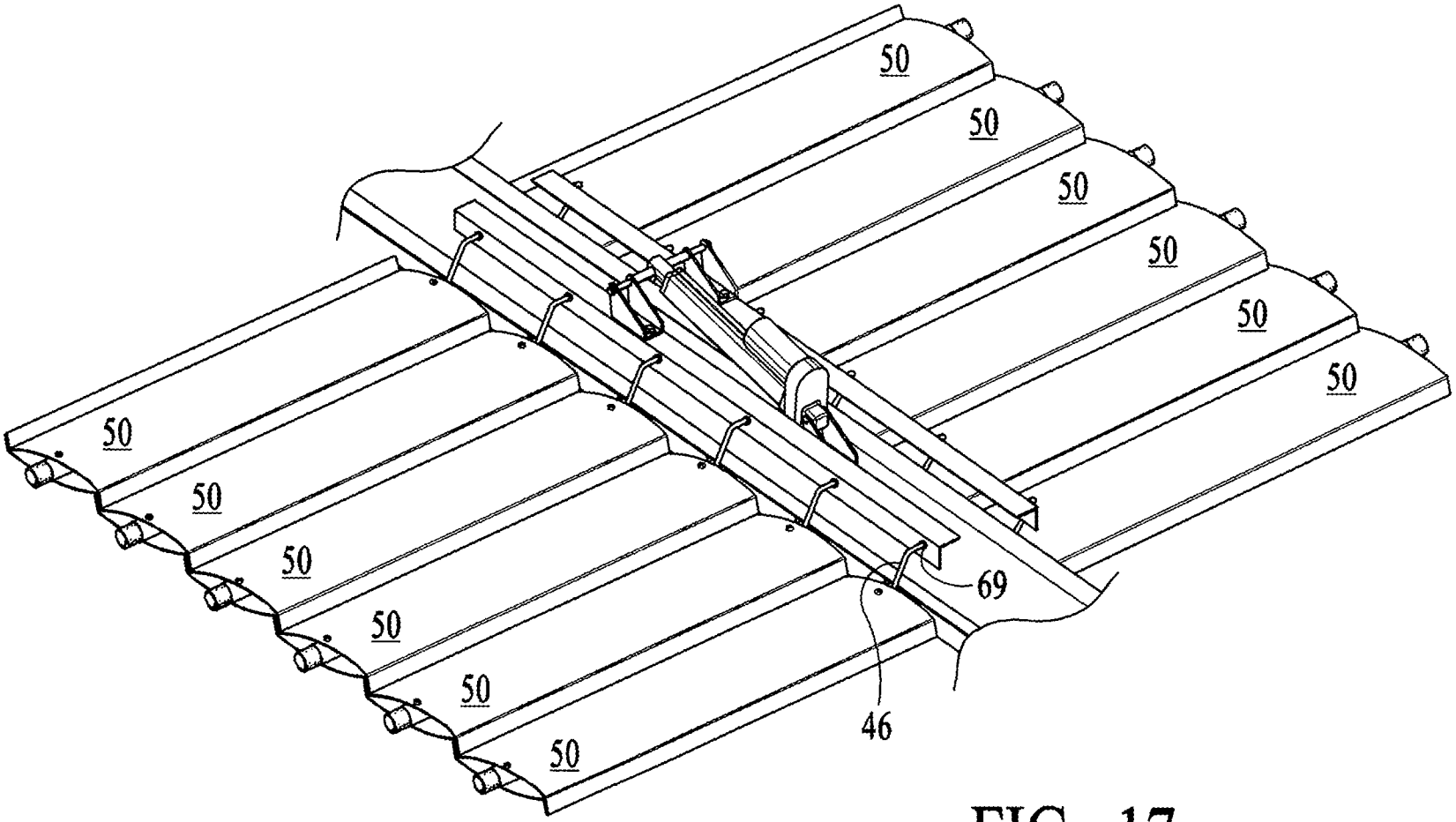
FIG. 17 is a view showing in closeup the connection of two sets of louvers to two drive bars

FIG. 17 a front top perspective view shows the arm bars in a different position and the piston withdrawn such that the louvers are linearly aligned in both sets and as such the covered patio is closed. Since as seen better in FIG. 15, the front downwardly disposed edge of louver number two overlies the upwardly disposed rear edge of louver number 1, when in closed position, leakage of rain or snow or wind is avoided due to a seal formation.

Figure 18:
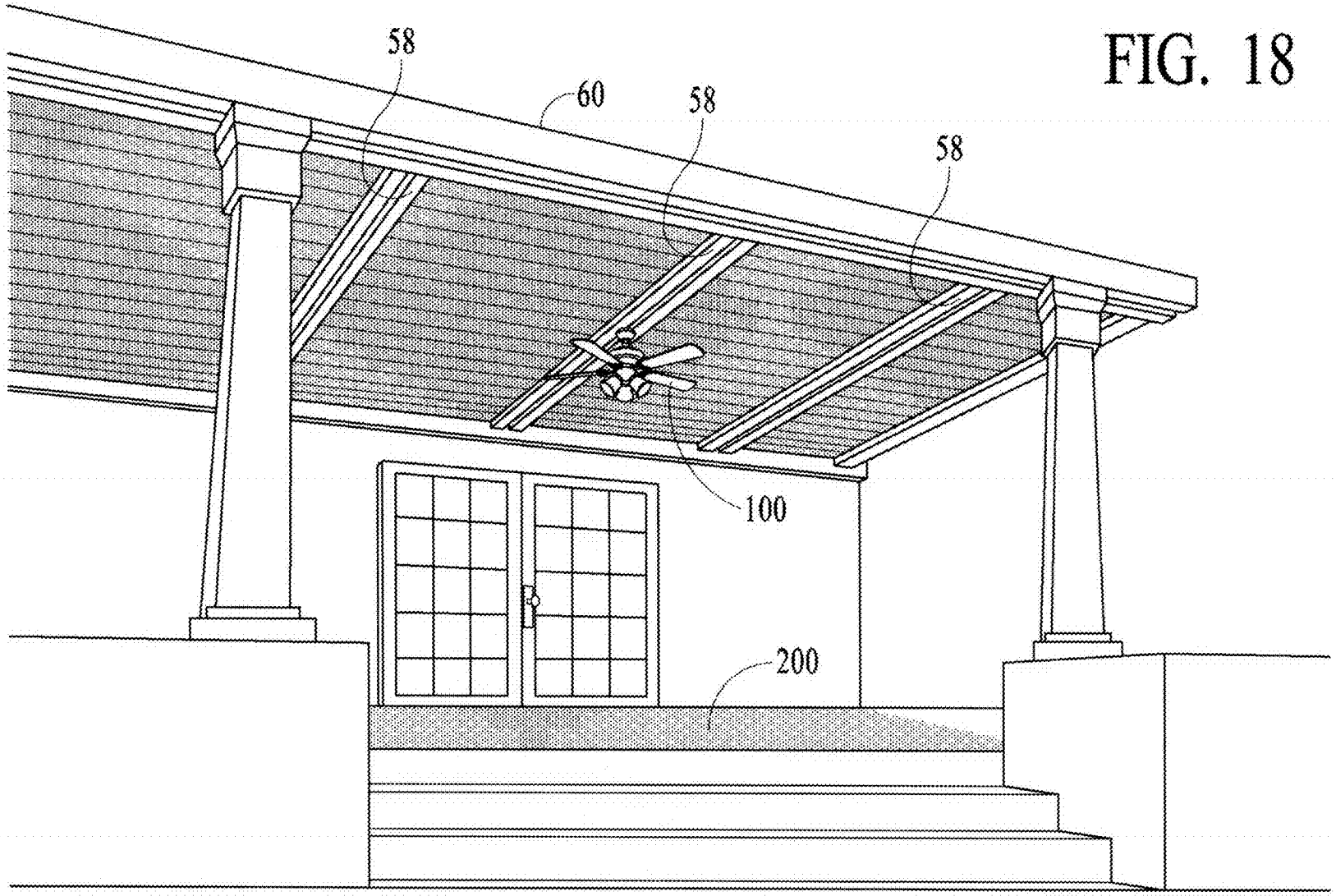
FIG. 18 is a bottom perspective view of a covered patio or pergola with the two sets of louvers closed.
Figure 19:
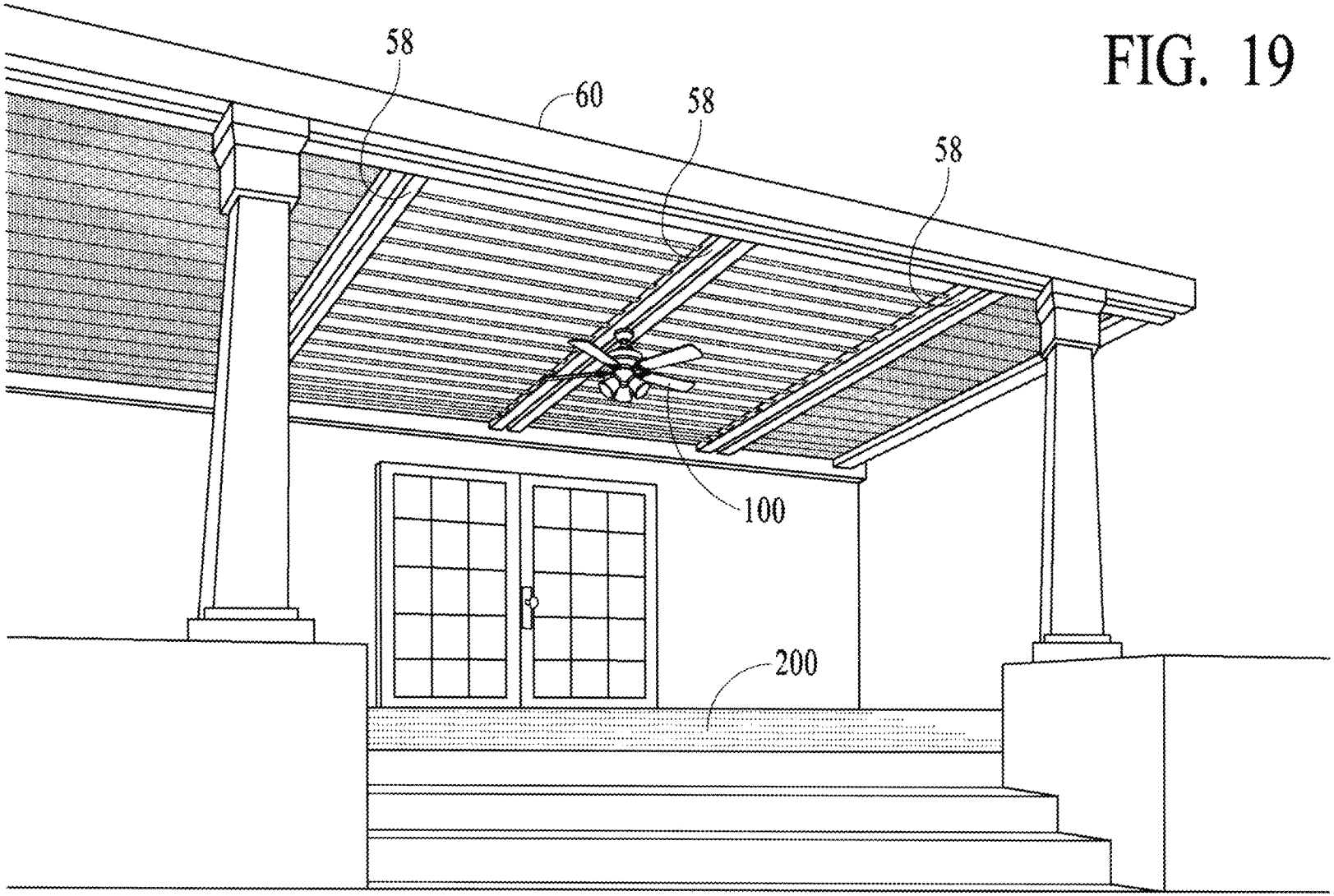
FIG. 19 is a view from the same perspective as FIG. 18 but wherein the louvers are in open position. (The fan shown forms no part of this invention.)

The reader is now directed to FIG. 18 which is an underside view and which depicts the seal between adjacent louvers. FIG. 19 is from the same perspective as FIG. 18, underneath the covered patio. Here the dual sets of louvers are seen in the open position.

It is seen that applicant has disclosed an improved aerodynamic louver capable of sealing against the next adjacent louver in a louver set. He has also disclosed an improved mode of linearly actuating the movement of the louvers with significantly less structure than is employed in prior art linear motion openable covered patios.

The louvers described herein may range in length from about 2 feet to about 10 feet long or even as longer.

Since certain changes may be made in the above described apparatus without departing from the scope of the invention herein involved, it is intended that all matter contained in the above description and in the accompanying drawings, if present, shall be interpreted as illustrative only and not in a limiting sense

I claim:

1. A louvered roof system comprising a plurality of louvers mounted within a frame, each louver configured for movement between an open position and a closed position, each of the plurality of louvers having:

an upper surface and a lower surface of similar length and width, each surface having outer edges and full-length tabular ends formed from an engagement of said edges of each respective surface, a tabular end adjacent the upper surface facing generally upwardly, and a tabular end adjacent the lower surface facing generally downwardly;

each of the plurality of louvers having a tube disposed at about the midpoint between the two surfaces of each louver to separate the two surfaces; and each of the plurality of louvers forming an airfoil shaped structure;

each said tube having a polymeric plug at a terminii thereof, wherein a generally inverted L-shaped pin is disposed in one of said polymeric plugs of each louver, and said pin connects each respective louver to a moveable arm bar which is capable of reciprocated movement, said arm bar being connected to a linear drive mechanism mounted to the frame; and a gutter beam which comprises a generally L-shaped member with a U-shaped channel disposed on a vertical leg of said generally L-shaped member, which the U-shaped channel has a first vertical wall, a horizontal wall connected thereto, and a spaced second vertical wall of the same elevation as the first vertical wall of the U-shaped channel, said second vertical wall having a series of spaced U-shaped openings along the length thereof for receipt of each polymeric plug of the respective louver.

2. The louvered roof system of claim 1, wherein when the louvers are in said closed position, the downward tabular end of each said louver overlaps the upward tabular end of a next adjacent louver to prevent rain and light from passing between the closed louvers.

3. The roof system of claim 1, wherein each polymeric plug having an inverted L-shaped pin therein, is disposed for rotation within one of a series of linearly aligned bores of said gutter beam, said gutter beam being attached to the frame, and another polymeric plug lacking an inverted L-shaped pin is also mounted for rotational movement.

4. The louvered roof system of claim 1 wherein each louver of the plurality of louvers is substantially the same shape.

5. The louvered roof system of claim 1 wherein the gutter beam is overlaid with a gutter cover that overlays in part each of the U-shaped openings in the gutter beam, to prevent the polymeric plugs from escaping from their respective U-shaped opening during rotation of the louvers.

6. The louvered roof system of claim 3 wherein a single set of said louvers is disposed for rotation by a single linear drive system.

7. The louvered roof system of claim 3 including a dual set of louvers forming two sets of said louvers, both sets being rotated by a single linear drive system.

8. The single set of said louvers of the louvered roof system of claim 6 including a system mounted linear actuator having a piston therein, which is capable of linear movement upon actuation, extends forwardly from the body of the linear actuator, which piston has a throughbore to which an attachment means for the single louver set is disposed, said attachment means for the single louver set comprising a polymeric cylinder disposed in said throughbore, and wherein a clevis pin passes through a first end of a clevis, then through a shoe attached to said clevis, then through said polymeric cylinder and is attached to the second end of the clevis, said shoe also being attached to the arm bar in a fixed manner such that as the piston goes forwardly or rearwardly, the arm bar moves in the same direction.

9. The dual set of louvers of the louvered roof system of claim 7 further including a roof system mounted linear actuator having a piston therein which is capable of linear movement upon actuation, extends forwardly from the body of the linear actuator, which piston has a throughbore to which an attachment means for the dual set of louvers is disposed, said attachment means comprising: two linearly spaced shoes each attached to a respective arm bar, one on each side, laterally from the mounted linear actuator, wherein a threaded bolt passes through a first shoe of the two linearly spaced shoes, then through a polymeric cylinder attached transversely to the linear actuators piston, and then through a second shoe of the two linearly spaced shoes, which bolt is secured to the second shoe by a washer and nut or a lock nut.

10. A louvered roof system comprising:

a plurality of aerodynamically configured louvers mounted within a frame, each of the plurality of louvers having an upper surface and a lower surface of similar length and width, each surface having outer edges and full-length tabular ends formed from an engagement of the said edges of each respective surface, a tabular end adjacent the upper surface facing generally upwardly, and a tabular end adjacent the lower surface facing generally downwardly, each louver having a tube disposed at about the midpoint between the two surfaces of each louver to separate the two surfaces and each of the plurality of louvers forming an airfoil shaped structure;

a direct coupled linear drive motor system; wherein each louver is configured for movement between an open position and a closed position by said direct coupled linear drive motor system, which said linear drive motor system comprises a linear drive motor having a piston to which is coupled at least one shoe mounted on a movable arm bar which is capable of reciprocated movement;

said roof system having a set of said louvers each with a cylindrical plug extending outwardly therefrom disposed for rotation within a respective U-shaped opening of a series of spaced U-shaped openings in a gutter beam, and wherein each louver has an inverted L-shaped pin connected from said cylindrical plug to said movable arm bar; said arm bar being connected to said linear drive motor system mounted to the frame; and said gutter beam comprises a generally L-shaped member with a U-shaped channel disposed on a vertical leg of said generally L-shaped member, wherein said U-shaped channel has a first vertical wall, a horizontal wall connected thereto, and a spaced second vertical wall of the same elevation as the first vertical wall of the U-shaped channel, said second vertical wall having said series of spaced U-shaped openings along the length thereof for receipt of each cylindrical plug of the respective louver.

11. The roof system of claim 10 further including two shoes disposed laterally in opposite directions from said linear drive motor system, each shoe connected to a separate arm bar for rotating two sets of said aerodynamically configured louvers.

12. A louver for a louvered roof system that opens and closes, said louver comprising:

an upper surface and a lower surface of similar length and width, each surface having outer edges and full-length tabular ends formed from the engagement of the said edges of each respective surface, a tabular end adjacent the upper surface facing generally upwardly, and a tabular end adjacent the lower surface facing generally downwardly;

said louver having a tube disposed at about the midpoint between the two surfaces of said louver to separate the two surfaces; said louver forming an airfoil shaped structure;

said tube having a polymeric plug at the terminii thereof, and wherein a generally inverted L-shaped pin is disposed in said polymeric plugs of said louver, and said pin connected to a moveable arm bar which is capable of reciprocated movement, said arm bar being connected to a linear drive mechanism mounted to a frame; and a gutter beam which comprises a generally L-shaped member with a U-shaped channel disposed on a vertical leg of said generally L-shaped member, which the U-shaped channel has a first vertical wall, a horizontal wall connected thereto, and a spaced second vertical wall of the same elevation as the first vertical wall of the U-shaped channel, said second vertical wall having a series of spaced U-shaped openings along the length thereof for receipt of the polymeric plug of the louver.

13. The louver of claim 12 wherein the length of the louver extends between two feet and ten feet in length.

14. A louvered roof system comprising a plurality of louvers mounted within a frame, and each louver configured for movement between an open position and a closed position, each of the plurality of louvers having:

an upper surface and a lower surface of similar length and width, each surface having outer edges and full-length tabular ends formed from an engagement of the said edges of each respective surface, a tabular end adjacent the upper surface facing generally upwardly, and a tabular end adjacent the lower surface facing generally downwardly;

each of the plurality of louvers having a tube disposed at about the midpoint between the two surfaces of each louver to separate the two surfaces; and each of the plurality of louvers forming an airfoil shaped structure;

each said tube having a polymeric plug at a terminii thereof, wherein a generally inverted L-shaped pin is disposed in one of said polymeric plugs of each louver, and said pin connects each respective louver to a moveable arm bar which is capable of reciprocated movement, said arm bar being connected to a linear drive motor system mounted to the frame;

a gutter beam which comprises a generally L-shaped member with a U-shaped channel disposed on a vertical leg of said generally L-shaped member, which the U-shaped channel has a first vertical wall, a horizontal wall connected thereto, and a spaced second vertical wall of the same elevation as the first vertical wall of the U-shaped channel, said second vertical wall having a series of spaced U-shaped openings along the length thereof for receipt of each polymeric plug of the respective louver;

wherein the gutter beam is overlaid with a gutter beam cover that overlays in part each of the U-shaped openings in the gutter beam, to prevent said polymeric plugs from escaping from their respective U-shaped opening during rotation of the louvers; and wherein each polymeric plug having an inverted L-shaped pin therein, is disposed for rotation within one of a series of linearly aligned bores of said gutter beam, said gutter beam being attached to the frame, and another polymeric plug lacking an L-shaped pin is also mounted for rotational movement.

* * * * *